US008727463B2

(12) United States Patent
Sanekata

(10) Patent No.: US 8,727,463 B2
(45) Date of Patent: May 20, 2014

(54) IMAGE RECORDING APPARATUS AND IMAGE RECORDING METHOD

(75) Inventor: Takahito Sanekata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 13/272,504

(22) Filed: Oct. 13, 2011

(65) Prior Publication Data

US 2012/0098878 A1 Apr. 26, 2012

(30) Foreign Application Priority Data

Oct. 25, 2010 (JP) ..... 2010-238767

(51) Int. Cl.
*B41J 2/01* (2006.01)

(52) U.S. Cl.
USPC ..... 347/1

(58) Field of Classification Search
None
See application file for complete search history.

(56) References Cited

U.S. PATENT DOCUMENTS

| | | | | |
|---|---|---|---|---|
| 7,102,658 | B2 | 9/2006 | Sanbongi et al. | |
| 2006/0082638 | A1 * | 4/2006 | Sanbongi et al. | 347/213 |
| 2007/0159519 | A1 * | 7/2007 | Kohira et al. | 347/218 |

FOREIGN PATENT DOCUMENTS

| | | |
|---|---|---|
| JP | 2010-125830 | 6/2010 |

* cited by examiner

*Primary Examiner* — Stephen Meier
*Assistant Examiner* — Alexander C Witkowski
(74) *Attorney, Agent, or Firm* — Workman Nydegger

(57) ABSTRACT

An image recording apparatus includes: a transport unit that transports a medium, which includes a recording material one side of which is a recording layer for an image and the other side of which is an adhesive layer and also includes a separating material covering the adhesive layer, along a transport path using a plurality of transport rollers; a recording unit that records an image on the medium; and a heating unit that fixes the image recorded on the medium. In the image recording apparatus, there are sequentially provided two units of the transport rollers in the transport path, the two transport rollers respectively make contact with different surfaces of the medium, and the outer diameter of one of the transport rollers is different in size from the outer diameter of the other of the transport rollers.

7 Claims, 6 Drawing Sheets

| EVALUATION CONDITION | OCCURRENCE OF SEPARATION |
|---|---|
|  | NO |
|  | NO |
|  | NO |
|  | YES |

IMAGE RECORDING APPARATUS AND IMAGE RECORDING METHOD

This application claims the benefit of Japanese Patent Application No. 2010-238767, filed on Oct. 25, 2010, which is hereby incorporated herein by reference in its entirety.

BACKGROUND

1. Technical Field

The present invention relates to image recording apparatuses and image recording methods.

2. Related Art

As image recording apparatuses, printers that discharge ink from a head onto a medium such as paper and the like so as to print an image are provided. Among the printers, there exists a type of printer that includes a drying unit (heating unit) which fixes an image printed on a medium by heating the medium on which the image has been printed (for example, JP-A-2010-125830).

In some case, an image is printed on seal paper that is integrally configured of a recording sheet (recording material) in which the side opposite to the print surface is an adhesive layer, and a separator (separating material) that covers the adhesive layer. The inside of the main body of a printer is made relatively high at temperature by a drying unit. Accordingly, if the seal paper is left unprocessed for a long time in a state in which the seal paper is wound upon a transport roller (especially, a roller with a shorter outer diameter), moisture in the seal paper vaporizes so that the seal paper is made to have a tendency to curve along the transport roller. After this, if the seal paper having the tendency mentioned above is wound upon the transport roller in a state in which the portion of the seal paper having that tendency is curved to the reverse direction, the recording sheet and the separator are likely to be separated from each other.

SUMMARY

An advantage of some aspects of the invention is to prevent seal paper from being separated between a recording material and a separating material.

In order to solve the problem described above, an image recording apparatus according to one of the main aspects of the invention includes: a transport unit that transports a medium, which includes a recording material one side of which is a recording layer for an image and the other side of which is an adhesive layer and also includes a separating material covering the adhesive layer, along a transport path using a plurality of transport rollers; a recording unit that records an image on the medium; and a heating unit that fixes the image recorded on the medium. Further, in the image recording apparatus, it is preferable that two units of the transport rollers be sequentially provided in the transport path, the two transport rollers respectively make contact with different surfaces of the medium, and the outer diameter of one of the transport rollers be different in size from the outer diameter of the other of the transport rollers.

With such image recording apparatus, it is possible to prevent the seal paper from being separated between the recording material and the separating material.

In the aforementioned image recording apparatus, it is preferable that three units of the transport rollers be sequentially provided in the transport path, a surface of the medium with which the first and third transport rollers from the upstream side of the transport path make contact be different from a surface of the medium with which the second transport roller makes contact, and the outer diameter of the second transport roller be larger than the outer diameter of the first transport roller and the outer diameter of the third transport roller.

With such image recording apparatus, it is possible to prevent the seal paper from being separated between the recording material and separating material. Further, as the diameter of only one of the three transport rollers is made larger, it is possible, for example, to reduce costs, transport a medium with a smaller transport force, and so on.

In the aforementioned image recording apparatus, it is preferable that three units of the transport rollers be sequentially provided in the transport path, the surface of the medium with which the first and third transport rollers from the upstream side of the transport path make contact be different from the surface of the medium with which the second transport roller makes contact, and the outer diameter of the first transport roller and the outer diameter of the third transport roller be larger than the outer diameter of the second transport roller.

With such image recording apparatus, it is possible to prevent a separation between the recording material and separating material.

In the aforementioned image recording apparatus, it is preferable that two units of the transport rollers be sequentially provided in the transport path, and the two transport rollers that have different outer diameters from each other be positioned further upstream of the transport path with respect to a region where the recording unit records an image on the medium.

With such image recording apparatus, it is possible to record an image in a state in which the recording material and the separating material are not separated from each other. As a result, it is possible to prevent the medium from making contact with the recording unit, prevent the skew of an image forming position from happening, and so on.

An image recording method according to another aspect of the invention is a method of recording an image on a medium using an image recording apparatus that includes: a transport unit that transports the medium, which includes a recording material one side of which is a recording layer for an image and the other side of which is an adhesive layer and also includes a separating material covering the adhesive layer, along a transport path using a plurality of transport rollers; a recording unit that records the image on the medium; and a heating unit that fixes the image recorded on the medium. Further, in the image recoding apparatus, it is preferable that two units of the transport rollers be sequentially provided in the transport path, the two transport rollers respectively make contact with different surfaces of the medium, and the outer diameter of one of the transport rollers be different in size from the outer diameter of the other of the transport rollers.

With such image recording method, it is possible to record an image in a state in which the recording material and the separating material are not separated from each other. As a result, it is possible to prevent the medium from making contact with the recording unit, prevent the skew of an image forming position from occurring, and so on.

BRIEF DESCRIPTION OF THE DRAWINGS

The invention will be described with reference to the accompanying drawings, wherein like numbers reference like elements.

DESCRIPTION OF EXEMPLARY EMBODIMENTS

Printer

An embodiment of the invention will be described below exemplifying an ink jet printer (hereinafter, called a printer) as an "image recording apparatus."

Figure 1:
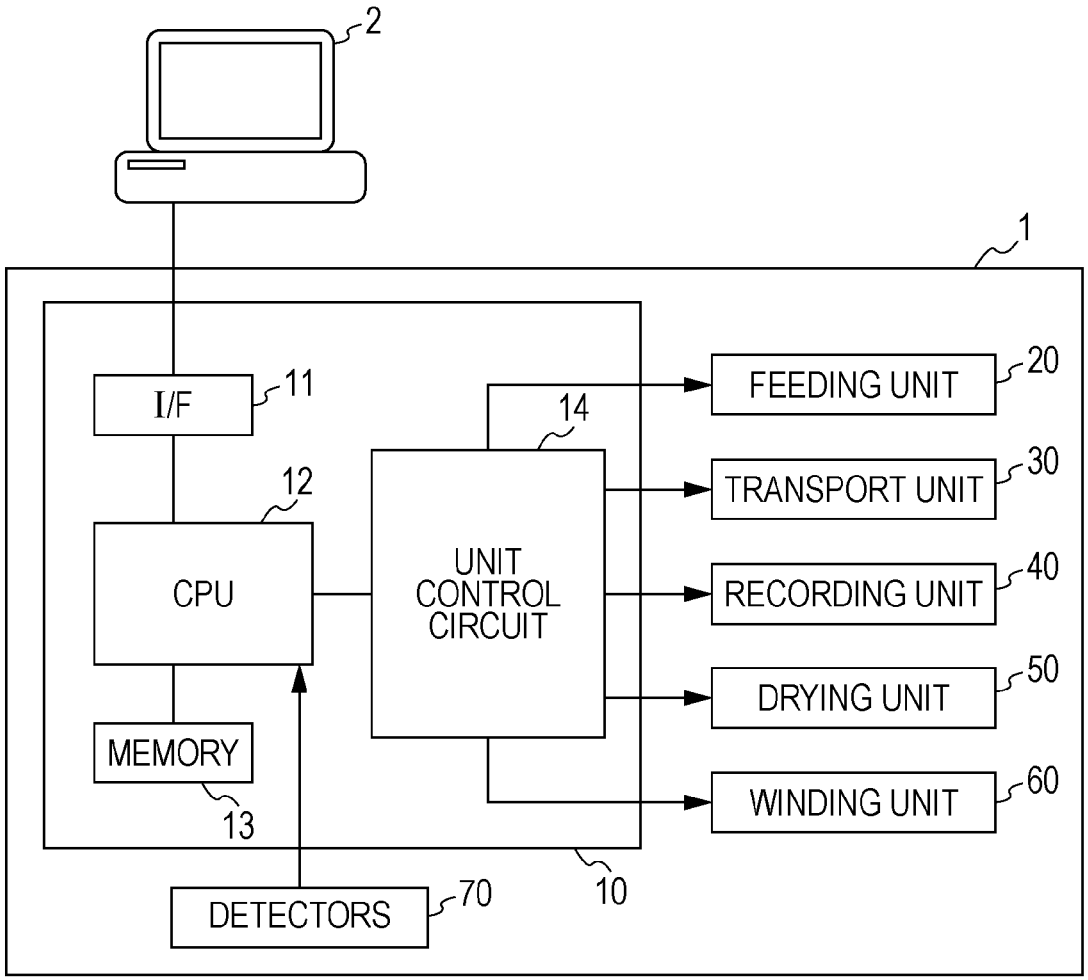
FIG. 1 is a block diagram illustrating the overall configuration of a printer.
Figure 2:
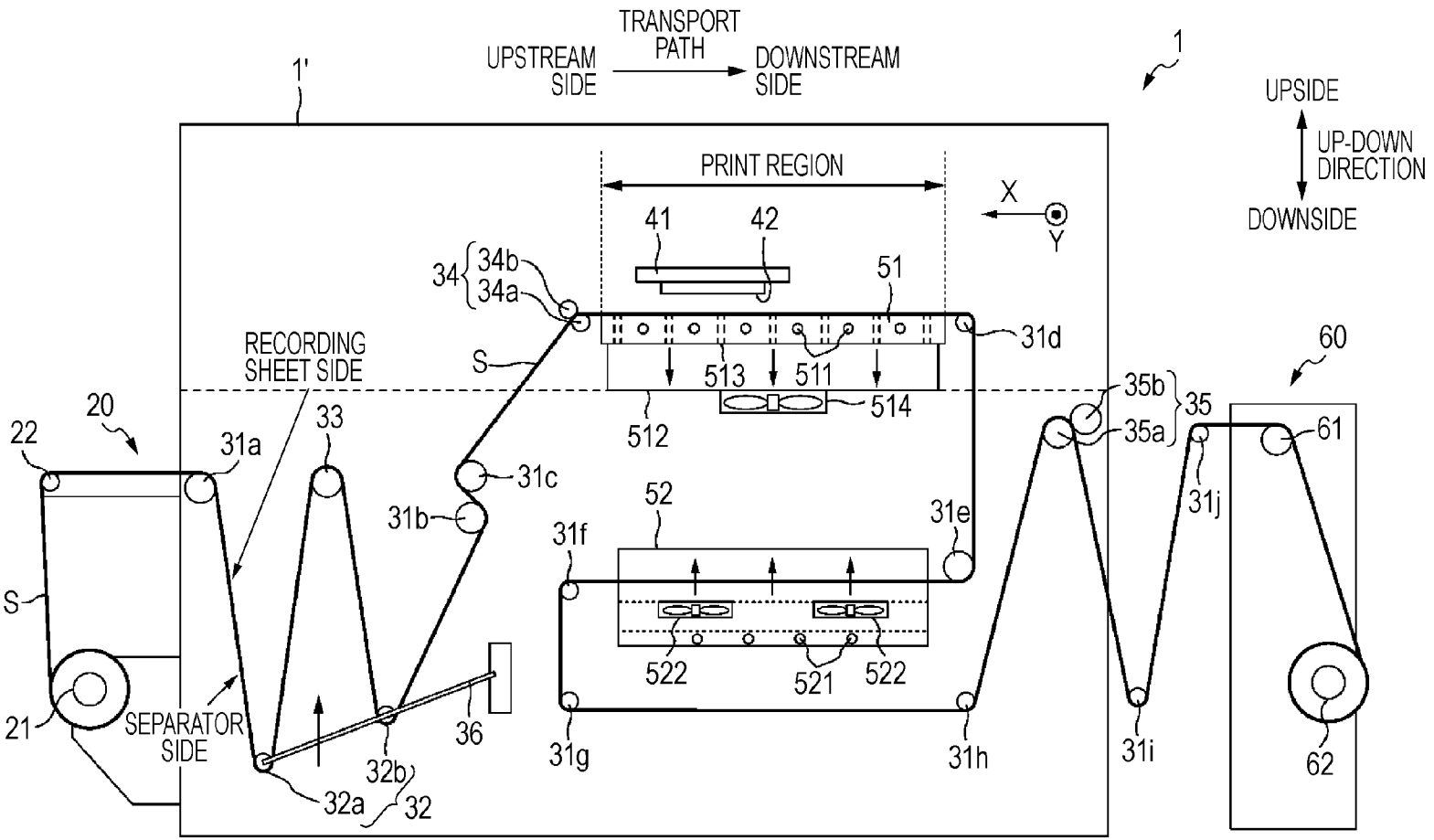
FIG. 2 is a cross-sectional view schematically illustrating a printer.

FIG. 1 is a block diagram illustrating the overall configuration of a printer 1. Meanwhile, FIG. 2 is a cross-sectional view schematically illustrating the printer 1. The printer 1 according to the embodiment prints an image on roll paper S (continuous form paper) as a medium. Further, the printer 1 is communicably connected to a computer 2, and the computer 2 creates print data so as to make the printer 1 print an image. It is to be noted that the functions of the computer 2 may be installed in the printer 1.

A controller 10 is a control unit that controls the printer 1. An interface unit 11 is a unit that carries out data transmission between the computer 2 and the printer 1. A CPU 12 is an arithmetic processing unit that controls the printer 1 as a whole. A memory 13 is a unit that provides a storage area for a program of the CPU 12, a working area, and the like. The CPU 12 controls each unit in accordance with a unit control circuit 14. Detectors 70 monitor various conditions of the printer 1 and the controller 10 controls each unit based on the detected results.

A feeding unit 20 is a unit that feeds the roll paper S to a transport unit 30. The feeding unit 20 includes a scroll roller 21 around which the roll paper S is wound and that is rotatably supported, and a relay roller 22 that winds thereupon the roll paper S fed from the scroll roller 21 so as to guide it to the transport unit 30. Note that the feeding unit 20 is located outside of a main body 1' of the printer 1 in which image printing is carried out.

The transport unit 30 (corresponding to the aforementioned transport unit) is a unit that transports the roll paper S, fed from the feeding unit 20, from the upstream side to the downstream side along a preset transport path. The transport unit 30 includes a plurality of relay rollers 31*a* through 31*j*, a movable roller 32, a fixed roller 33, a supply roller 34, and a discharge roller 35. The movable roller 32 and the fixed roller 33 are provided between the feeding unit 20 and a print region, the supply roller 34 is provided on the immediate upstream side of the print region, and the discharge roller 35 is provided on the downstream side of the print region. The transport path that transports the roll paper S is formed by the movement of the roll paper S sequentially passing through these rollers (hereinafter, called transport rollers).

The supply roller 34 and the discharge roller 35 are each configured of a pair of rollers. In each pair of the rollers, one is a drive roller (34*a* or 35*a*) rotated by a motor (not shown), and the other is a slave roller (34*b* or 35*b*) rotated by rotation of the drive roller. Upon completion of image printing on the roll paper S placed in the print region, a portion of the roll paper S on which the image has been printed is discharged from the print region by the supply roller 34, the discharge roller 35 and the like, thereafter a new portion of the roll paper S on which no image has been printed yet is supplied to the print region. That is to say, operation of image printing on the roll paper S placed in the print region and operation of transporting the roll paper S are repeated.

The movable roller 32 is configured of a first movable roller 32*a* and a second movable roller 32*b*. Both ends of each of the rotational shafts of the first movable roller 32*a* and second movable roller 32*b* are attached to a pair of arms 36 so that the rollers can rotate. The arms 36 can operate in a movable state in an up-down direction of the printer 1. Accordingly, with the operation of the arms 36, the first movable roller 32*a* and second movable roller 32*b* operate while moving in the up-down direction. On the other hand, the fixed roller 33 is fixed at a predetermined position in the up-down direction of the printer 1.

In the transport unit 30, the roll paper S in an amount equivalent to the length of the print region in an X direction is transported at a predetermined speed per transport operation. However, in some case, a sufficient amount of the roll paper S cannot be fed from the feeding unit 20 (scroll roller 21) in the transport operation because the paper roll S is heavy in weight right after it has been exchanged, for example. In order to cope with such issue, in the printer 1 of the embodiment, the roll paper S in the amount transported per transport operation is wound upon the movable roller 32 and the fixed roller 33 in a slack state; whereby, if feeding-out of the roll paper S from the feeding unit 20 is delayed in the transport operation, the movable roller 32 and the arms 36 are lifted so that the roll paper S wound in the slack state is supplied to the print region. As a result, the roll paper S in a predetermined length can be supplied to the print region in a predetermined transport time.

A recording unit 40 (corresponding to the aforementioned recording unit) is a unit that prints (records) an image on the roll paper S placed in the print region. The recording unit 40 includes a carriage 41 and a head 42. The carriage 41 moves the head 42 in the X direction (direction in which the roll paper S is transported) and a Y direction (width direction of the roll paper S) while being guided by a guide shaft (not shown). The head 42 is a unit that discharges ink onto the roll paper S, and a plurality of nozzles are provided as an ink discharge portion in the lower face of the head 42. The head 42 discharges ink while moving together with the carriage 41 in the X and Y directions, thereby printing a two-dimensional image on the roll paper S.

The roll paper S placed in the print region is supported by the upper surface of a platen 51 from the reverse surface side of the roll paper S opposite to the print surface. A method of discharging ink through the nozzles can be either one of a piezoelectric method and a thermal method. In the piezoelectric method, a voltage is applied to a drive element (piezoelectric element) to make a pressure chamber expand and contract so as to discharge ink. Meanwhile, in the thermal method, an air bubble is generated in a nozzle by a heating element so that the ink is discharged by the air bubble.

A drying unit 50 (corresponding to the aforementioned drying unit) is a unit that fixes an image printed on the roll paper S (dries ink landed on the roll paper S), and includes the platen 51 and a drying furnace 52.

A plurality of heaters 511 (e.g., Nichrome wire) are disposed inside the platen 51. When an electric current flows in the heaters 511, the temperature of the platen 51 rises accordingly, which causes the temperature of the roll paper S on the platen 51 (i.e., the roll paper S placed in the print region) to rise as well. The heaters 511 are disposed across the entirety of the platen 51 so that the heat is conducted evenly to the roll paper S on the platen 51. As a result, it is possible to accelerate the pace of drying the ink landed on the roll paper S on the platen 51 and suppress bleeding of the ink in a printed image.

A suction hole 513 is provided in the platen 51, and a pressure chamber 512 and a fan 514 (axial fan) are provided on the lower side of the platen 51. When the fan 514 sucks air in the pressure chamber 512, the inside of the pressure chamber 512 is made in a negative-pressure state so that the roll paper S on the platen 51 is sucked through the suction hole 513. As a result, the roll paper S on the platen 51 is sucked and attached to the upper surface of the platen 51. In this manner, the roll paper S on the platen 51 is held on a predetermined position so that ink droplets can be landed at correct positions. In addition, even if the roll paper S is swollen due to the moisture of ink droplets, the roll paper S can be held in a flat state. It is to be noted that a method of holding the roll paper S is not limited to the method described above; it is advisable that the roll paper S is held by electrostatic adsorption, for example.

The drying furnace 52 is provided further downstream of the transport path with respect to the print region, and a plurality of heaters 521 and a plurality of fans 522 are disposed therein. In the drying furnace 52, air heated by the heaters 521 is blown by the fans 522 to the print surface of the roll paper S supplied into the drying furnace 52. As a result, ink that configures an image printed on the roll paper S can be dried so that the image printed on the roll paper S can be fixed onto the roll paper S. Accordingly, even if a portion of the roll paper S on which the image has been printed is wound in a roll form, the reverse surface of the roll paper S is prevented from being got dirty by ink so that a printed material with high quality can be provided. It is to be noted that a configuration of the drying furnace 52 is not limited to the configuration described above; a configuration in which air of high temperature blown to the roll paper S convects in the drying furnace 52, or a configuration in which only an operation to raise the temperature higher inside the drying furnace 52 is carried out by the heaters 521 may be employed.

The winding unit 60 is a unit that winds up the roll paper S (roll paper S on which printing has been carried out) delivered by the transport unit 30. The winding unit 60 includes a relay roller 61 that winds thereupon and transports the roll paper S delivered from the relay roller 31*j*, and a winding drive shaft 62 that winds the roll paper S therearound. Note that the winding unit 60 is positioned outside of the main body 1' of the printer 1.

Separation Mechanism

Figure 3A:
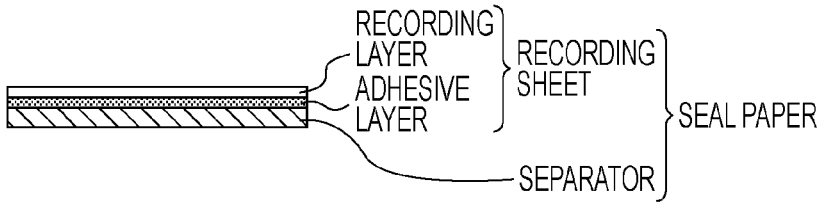
FIGS. 3A and 3B are descriptive views illustrating a medium.
Figure 3B:
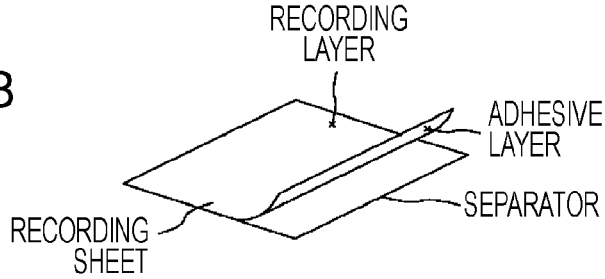

FIGS. 3A and 3B are descriptive views illustrating a medium (corresponding to the aforementioned roll paper S) used in the embodiment. In the embodiment, seal paper that includes: a recording sheet (corresponding to the aforementioned recording material) one surface of which is a recording layer for an image and the other surface of which is an adhesive layer; and a separator (corresponding to the aforementioned separating material) that covers the adhesive layer of the recording sheet, is used as a medium to record an image. As shown in FIG. 3B, the recording sheet and the separator can be separated from each other. Note that the recording sheet is not limited to paper, and can be a film or the like, for example. In the printer 1 shown in FIG. 2, the medium (roll paper S) is set so that the recording sheet (recording layer) faces the head 42 and the separator makes contact with the platen 51.

Figure 4:
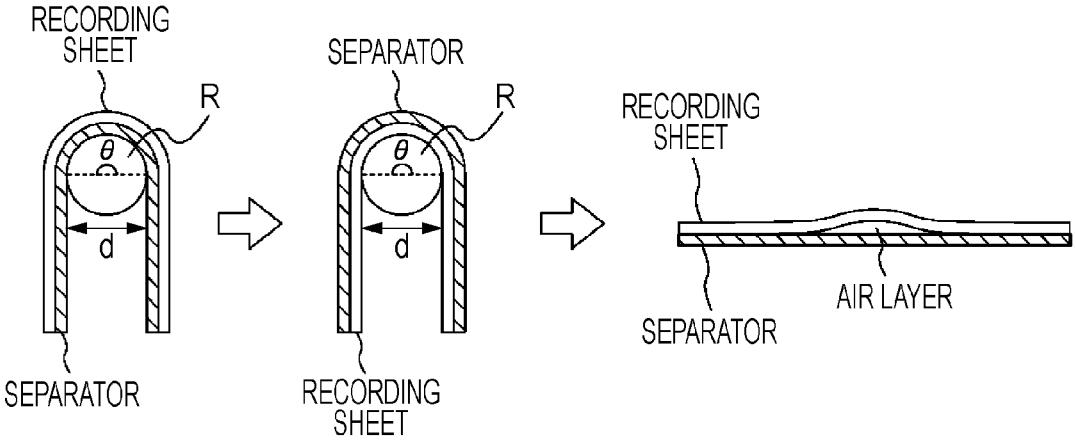
FIG. 4 is a descriptive view illustrating a separation mechanism.

FIG. 4 is a descriptive view illustrating a separation mechanism. A diagram on the left in FIG. 4 indicates a state where the medium is wound upon a transport roller R so that the transport roller R makes contact with the separator. A diagram in the middle in FIG. 4 indicates a state where the medium is wound upon the transport roller R so that the transport roller R makes contact with the recording sheet.

In order to fix an image printed on a medium, the platen 51 and drying furnace 52 having heaters are provided in the main body 1' of the printer 1. As these heaters heat the platen 51 and the drying furnace 52, the inside of the main body 1' of the printer 1 becomes relatively high at temperature due to the heated platen 51 (e.g., 45° C.) and drying furnace 52 (e.g., 75° C.)

Further, in some case, printing is suspended for a long time (for example, more than an hour) due to maintenance, for example, while the platen 51, the drying furnace 52 and the like are in a heated state. At this time, the medium is not transported and the same portion of the medium is kept staying on the same position. In other words, the same portion of the medium is wound upon the same transport roller R and left unprocessed for a long time in the main body 1' of the printer 1 at high temperature in some case. In this case, moisture in the medium vaporizes while the same portion of the medium being wound upon the same transport roller R.

In general, if moisture of a medium (recording sheet, separator, and so on) vaporizes, the medium (recording sheet, separator, and so on) becomes hardened. Further, if moisture of an adhesive agent (adhesive agent applied to a recording sheet) constituting an adhesive layer vaporizes, an adhesive strength of the adhesive agent is lowered. Therefore, if moisture in the medium vaporizes in a state where the same portion of the medium is wound upon the same transport roller R, the medium is made to have a tendency to have a curved shape just like being wound upon the transport roller R, and the adhesive strength of the adhesive layer is lowered. For example, if the medium is left unprocessed for a long time in the main body 1' of the printer 1 at high temperature while being wound upon the transport roller R, as shown in the diagram on the left in FIG. 4, the medium is made to have a tendency to have a curved shape with the separator being inside the curve.

Furthermore, in the main body 1' of the printer 1, as shown in FIG. 2, two transport rollers R sequentially arranged in the transport path make contact with different surfaces of a medium from each other in some case. Accordingly, for example, after the medium has been left unprocessed for a long time in the main body 1' of the printer 1 at high temperature while being wound upon the transport roller R in contact with the separator, as shown in the diagram on the left in FIG. 4, the medium is wound upon the transport roller R so that the transport roller R makes contact with the recording sheet, as shown in the diagram in the middle of FIG. 4, in some case.

That is to say, a portion of the medium that has a tendency to have a curved shape with the separator being inside the curve and in which an adhesive strength of the adhesive layer is lowered is caused to curve to the reverse direction with the recording sheet being inside the curve in some case. Consequently, as shown in the diagram on the right in FIG. 4, the recording sheet and the separator are separated from each other at the portion of the medium having the tendency mentioned above so that an air layer is generated between the recording sheet and the separator (hereinafter, this mechanism is referred to as "separation mechanism"). In other words, if the medium is left unprocessed for a long time in the main body 1' of the printer 1 at high temperature while being wound upon the transport roller R in contact with one surface side (separator or recording sheet) of the medium, the separation occurs right after the time when the medium is wound upon the transport roller R so that the transport roller R makes contact with the other surface side of the medium. If a separation occurs in a medium, the medium is defective as a product.

A medium placed at the print region is sucked and adsorbed by the platen 51 from the separator side. Therefore, if a separation has occurred in a medium placed at the print region (that is, if a separation occurs in the medium on the upstream side of the transport path with respect to the print region), a part of the recording sheet rises upward (toward the head 42 side) with respect to the separator, as shown in the diagram on the right in FIG. 4. Since a gap between a nozzle face of the head 42 and a medium (so-called paper gap) is generally set to be small, the rising part of the recording sheet makes contact with the head 42. This causes the recording sheet to be got dirty by the nozzle face of the head 42, leads to a failure of the head 42, and so on. Furthermore, if there exists a rising portion in the recording sheet, ink droplets discharged through the nozzles of the head 42 do not land on correct positions (dot-forming positions are deviated) so that image quality of the printed image is deteriorated.

Figure 5:
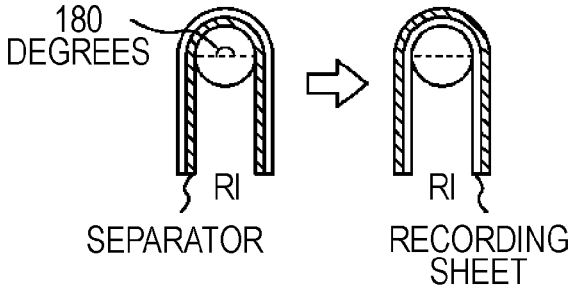
FIG. 5 is a view indicating evaluation test results regarding a separation mechanism.
Figure 5:
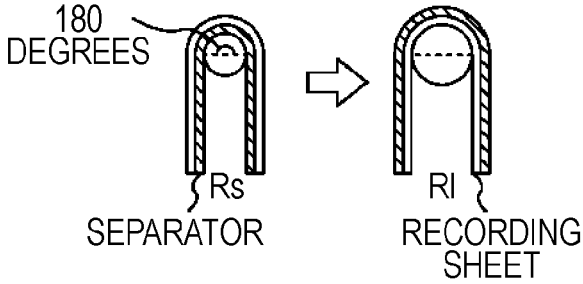
Figure 5:
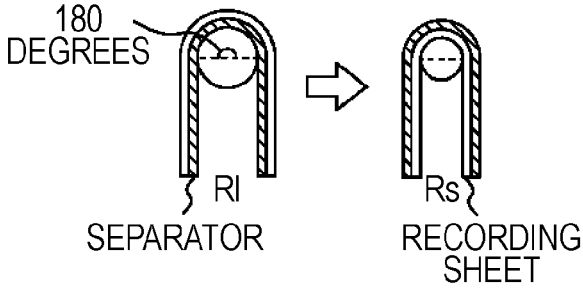
Figure 5:
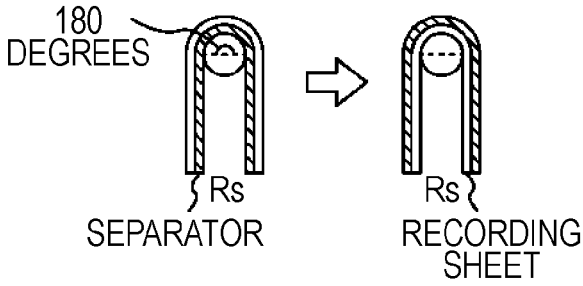

FIG. 5 is a view indicating evaluation test results regarding the separation mechanism. The printer 1 of the embodiment uses two types of transport rollers R whose outer diameters d (diameter d of the outer circumference surface of the transport roller R, as shown in FIG. 4) are different from each other. Hereinafter, the transport roller with a larger outer diameter d (for example, d=60 mm) is called a "large-diameter roller Rl," meanwhile the transport roller with a smaller outer diameter d (for example, d=40 mm) is called a "small-diameter roller Rs."

Occurrence/nonoccurrence of the separation was evaluated under four kinds of conditions. Note that an angle θ at which the medium is wound upon around the circumference surface of the transport roller R (a central angle with respect to a portion (arc) with which the medium makes contact around the circumference surface of the transport roller R, as shown in FIG. 4) is called a "winding angle θ." In the evaluation test, the test was carried out at a winding angle θ (of 180 degrees in this case) that is larger than the maximum winding angle θ of the transport roller R included in the printer 1 of the embodiment. Since an occurrence manner of separation differs depending on types of media, the evaluation test was carried out using the medium that is used by the printer 1 (recommended medium).

Under the first condition, the medium was wound upon the large-diameter transport roller Rl firstly so that the large-diameter roller Rl made contact with the separator, and was then left unprocessed for a long time in a housing at high temperature (temperature: 40° C., humidity: 30%, 2 hours). At the time, a predetermined tension was applied downward to one end and the other end of the medium wound upon the large-diameter roller Rl. Thereafter, the medium was reversely wound upon the large-diameter roller Rl so that the large-diameter roller Rl made contact with the recording sheet. It has been confirmed that the separation did not occur under the first condition by checking occurrence/nonoccurrence of the separation in the medium.

Under the second condition, the medium was wound upon the small-diameter roller Rs so that the small-diameter roller Rs made contact with the separator, and was left unprocessed for a long time in the housing at high temperature in a state in which a predetermined tension was applied to either end of the medium. Thereafter, the medium was reversely wound upon the large-diameter roller Rl so that the large-diameter roller Rl made contact with the recording sheet. The separation did not occur under the second condition.

Under the third condition, the medium was wound upon the large-diameter roller Rl so that the large-diameter roller Rl made contact with the separator, and was left unprocessed for a long time in the housing at high temperature in a state in which a predetermined tension was applied to either end of the medium. Thereafter, the medium was reversely wound upon the small-diameter roller Rs so that the small-diameter roller Rs made contact with the recording sheet. The separation did not occur under the third condition.

Under the fourth condition, the medium was wound upon the small-diameter roller Rs so that the small-diameter roller Rs made contact with the separator, and was left unprocessed for a long time in the housing at high temperature in a state in which a predetermined tension was applied to either end of the medium. Thereafter, the medium was reversely wound upon the small-diameter roller Rs so that the small-diameter roller Rs made contact with the recording sheet. The separation did occur under the fourth condition.

The following are what have been understood from the evaluation test results described above.

In the housing (main body 1' of the printer 1) at high temperature, after the medium has been left unprocessed for a long time in a state in which the medium has been wound upon the large-diameter roller Rl with one surface of the medium making contact with the roller, the separation does not occur even if the medium is reversely wound upon the large-diameter roller Rl or the small-diameter roller Rs with the other surface of the medium making contact with the roller. The reason for this is as follows: when the outer diameter d of the transport roller R is large as is the case of the large-diameter roller Rl, the degree to which the medium is curved is small. Accordingly, the medium is unlikely to have a tendency to have a curved shape even if moisture of the medium vaporizes in a state in which the medium is wound upon the large-diameter roller Rl.

Further, in the housing at high temperature, after the medium has been left unprocessed for a long time in a state in which the medium has been wound upon the small-diameter roller Rs with one surface of the medium making contact with the roller, the separation does not occur even if the medium is reversely wound upon the large-diameter roller Rl with the other surface of the medium making contact with the roller. The reason for this is as follows: even if the medium has been made to have a tendency to have a curved shape with one surface of the medium being inside the curve by the small-diameter roller Rs, the degree to which the medium is curved is small in the case where the medium is curved to the reverse direction by the large-diameter roller Rl. Therefore, the recording sheet and the separator are unlikely to be separated from each other.

On the other hand, in the housing at high temperature, after the medium has been left unprocessed for a long time in a state in which the medium has been wound upon the small-diameter roller Rs with one surface of the medium making contact with the roller, the separation occurs only when the medium is reversely wound upon the small-diameter roller Rs with the other surface of the medium making contact with the roller. The reason for this is as follows: after the medium has been made to have a tendency to have a curved shape with one surface of the medium being inside the curve by the small-diameter roller Rs, when the medium is curved to the reverse direction by the small-diameter roller Rs, the degree to which the medium is curved becomes large so that the recording sheet and the separator are separated from each other.

Although not indicated in FIG. 5, the following evaluation test was also carried out and the same test result as the result described above was obtained: the medium is left unprocessed for a long time in the housing at high temperature in a state in which the medium is wound upon the transport roller R with the recording sheet being wound inside first, thereafter the medium is wound upon the transport roller R with the separator being wound inside.

From the test results described above, it is understood that, in the case where two transport rollers R are provided sequentially in a transport path in the printer 1 and make contact with different surfaces of the medium from each other, the separation occurs if both the two transport rollers R are made to be the small-diameter rollers Rs.

In the printer 1 according to the embodiment, as shown in FIG. 2, there exist the transport rollers (movable rollers 32*a*, 32*b*, and fixed roller 33) that are sequentially provided at the positions further upstream of the transport path with respect to the print region and respectively make contact with different surfaces of the medium. To be more specific, the surface of the medium that makes contact with the first movable roller 32*a* positioned most upstream of the transport path is a recording sheet, the surface of the medium that makes contact with the subsequent fixed roller 33 is a separator, and the surface of the medium that makes contact with the further subsequent second movable roller 32*b* is the stated recording sheet.

Transport paths configured by the movable roller 32 and the fixed roller 33 will be described below.

Transport Paths in Comparison Example

Figure 6A:
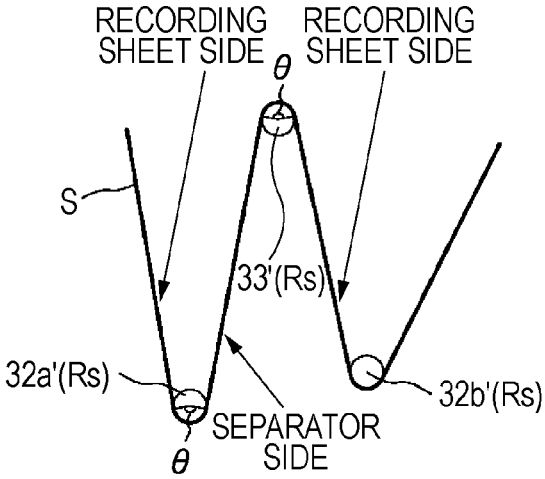
FIGS. 6A through 6C are descriptive views illustrating transport paths in a comparison example.
Figure 6B:
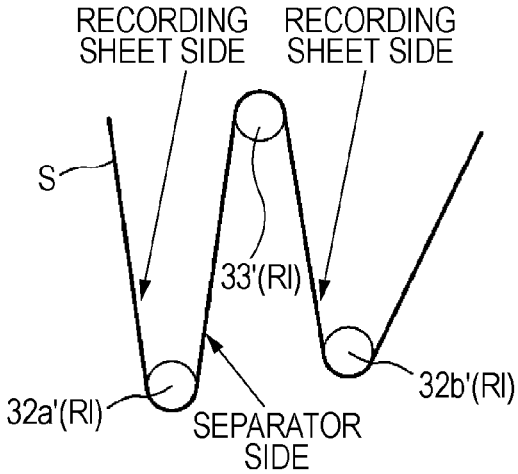
Figure 6C:
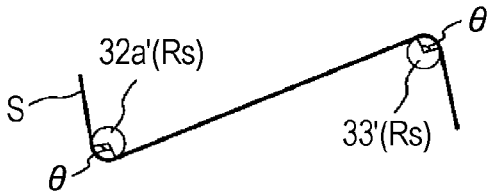

FIGS. 6A through 6C are descriptive views illustrating transport paths configured by movable rollers 32*a*', 32*b*' and a fixed roller 33' in a comparison example. In FIG. 6A, all of the two movable rollers 32*a*', 32*b*' and the fixed roller 33' are made to be the small-diameter rollers Rs. Here, suppose that the medium S has been left unprocessed for a long time in the main body 1' of the printer 1 at high temperature while being wounded upon each of the transport rollers 32*a*', 33' and 32*b*', as shown in FIG. 6A.

As a result, a portion of the medium S that has been wound upon the first movable roller 32*a*' becomes to have a tendency to have a curved shape with the recording sheet being inside the curve, and an adhesive strength of the adhesive layer thereof is lowered. Thereafter, when printing operation is restarted and the medium S is transported, the portion of the medium S having been wound upon the first movable roller 32*a*' is wound upon the fixed roller 33'. Consequently, the portion of the medium S that has a tendency to have a curved shape with the recording sheet being inside the curve and whose adhesive strength of the adhesive layer is lowered, is curved to the reverse direction with the separator being inside the curve by the fixed roller 33' as the small-diameter roller Rs so as to cause a separation to occur.

Similarly, a portion of the medium S that has been left unprocessed for a long time while being wound upon the fixed roller 33' becomes to have a tendency to have a curved shape with the separator being inside the curve and an adhesive strength of the adhesive layer thereof is lowered. Thereafter, when the medium S is transported and the portion of the medium S having been wound upon the fixed roller 33' is wound upon the second movable roller 32*b*' as the small-diameter roller Rs, the portion of the medium S above mentioned is curved to the reverse direction with the recording sheet being inside the curve so as to cause a separation to occur.

If a separation occurs in a portion of the medium S being placed further upstream of the transport path with respect to the print region in this manner, the medium S may make contact with the head 42, image quality of a printed image may be deteriorated, and so on.

In FIG. 6B, all of the two movable rollers 32*a*', 32*b*' and the fixed roller 33' are made to be the large-diameter rollers Rl. In this case, even if the medium S has been left unprocessed for a long time while being wound upon each of the transport rollers 32*a*', 33' and 32*b*' in the main body 1' of the printer 1 at high temperature, the medium S is unlikely to have a tendency to have a curved shape because the degree to which the medium S is curved by each of the transport rollers 32*a*', 33' and 32*b*' is small. Accordingly, it is possible to prevent the separation from occurring.

However, if all of the three transport rollers 32*a*', 33' and 32*b*' are made to be the large-diameter rollers Rl, costs are raised higher than in the case of using the small-diameter rollers Rs. In addition, it requires a larger transport force to transport the medium S (i.e., tension applied to the medium S) when the medium S is wound upon the large-diameter roller Rl than when it is wound upon the small-diameter roller Rs. Therefore, the output of a motor (i.e., motor that rotationally drives the transport roller R) is required to be larger in the transport path in FIG. 6B, which leads to a rise in costs, a rise in power consumption, and so on.

Accordingly, with the embodiment, it is intended to reduce costs, power consumption and the like, and to prevent the separation from occurring, by using the small-diameter rollers Rs.

In FIG. 6C, the distance in the lateral direction between the first movable roller 32*a*' and the fixed roller 33', both of which are the small-diameter rollers Rs, is extended, and the distance in the up-down direction therebetween is lessened. Consequently, in the transport path of FIG. 6C, each of the winding angles θ of the first movable roller 32*a*' and the fixed roller 33' can be made smaller than each of the winding angles θ thereof in the transport path of FIG. 6A. It is to be noted that, when the winding angle θ is small, the degree to which the medium S is curved by the transport roller R is also small. Therefore, even if the medium S has been left unprocessed for a long time while being wound upon each of the transport rollers 32*a*' and 33', as shown in FIG. 6C, in the main body 1' of the printer 1 at high temperature, the medium S is unlikely to have a tendency to have a curved shape so that the separation can be prevented from occurring.

However, if the distance in the lateral direction between the first movable roller 32*a*' and the fixed roller 33' is extended so as to make the winding angle θ smaller, the length in the lateral direction of the main body 1' of the printer 1 becomes longer so that the apparatus becomes larger in size. Further, if the distance in the up-down direction between the first movable roller 32*a*' and the fixed roller 33' is lessened so as to make the winding angle θ smaller, it becomes difficult to hold the medium S in a slack state sufficiently to cope with a case where feeding-out of the medium S from the feeding unit 20 is delayed.

Accordingly, with the embodiment, it is intended to prevent the separation from occurring without changing the winding angles θ on the transport rollers 32*a*', 33' and 32*b*' in a state in which the two movable rollers 32*a*', 32*b*' and the fixed roller 33' are fixed at appropriate design positions.

Transport Path of the Embodiment

Figure 7:
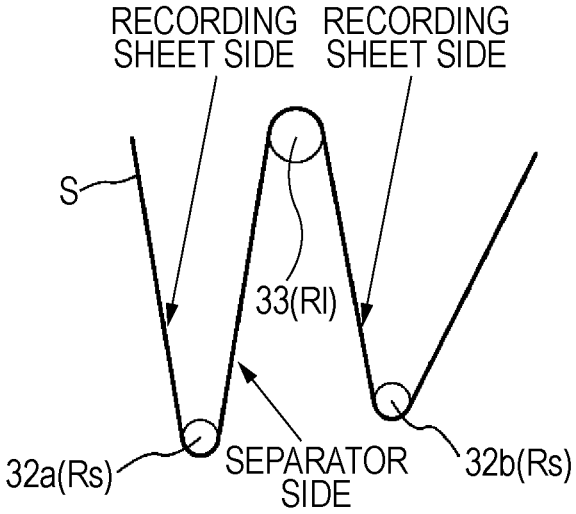
FIG. 7 is a descriptive view illustrating a transport path according to an embodiment.

FIG. 7 is a descriptive view illustrating a transport path configured by the movable rollers 32*a*, 32*b* and the fixed roller 33 according to the embodiment. In the embodiment, the first movable roller 32*a* is the small-diameter roller Rs, the fixed roller 33 is the large-diameter Rl, and the second movable roller 32*b* is also the small-diameter roller Rs. Note that a surface of the medium S that makes contact with the first movable roller 32*a* (recording sheet) and a surface of the medium S that makes contact with the subsequent fixed roller 33 (separator) are on the opposite sides of the medium S to each other, and further the surface of the medium S that makes contact with the fixed roller 33 (separator) and a surface of the medium S that makes contact with the subsequent movable roller 32*b* (recording sheet) are on the opposite sides of the medium S to each other.

Here, suppose that the medium S has been left unprocessed for a long time while being wound upon the transport rollers 32*a*, 33 and 32*b*, as shown in FIG. 7, in the main body 1' of the printer 1 at high temperature.

As a result, a portion of the medium S that has been wound upon the first movable roller 32*a* as the small-diameter roller Rs becomes to have a tendency to have a curved shape with the recording sheet being inside the curve, and an adhesive strength of the adhesive layer thereof is lowered. However, the portion of the medium S having been wound upon the first movable roller 32*a* is later wound upon the fixed roller 33 as the large-diameter roller Rl. Therefore, even if the portion of the medium S that has a tendency to have a curved shape with the recording sheet being inside the curve is curved to the reverse direction with the separator being inside the curve by the fixed roller 33, the degree to which the stated portion of the medium S is curved is small so that the separation can be prevented from occurring.

On the other hand, a portion of the medium S that has been left unprocessed for a long time while being wound upon the fixed roller 33 as the large-diameter roller Rl is not likely to have a tendency to have a curved shape because the degree to which the medium S is curved by the fixed roller 33 is small. Therefore, even if the portion of the medium S having been wound upon the fixed roller 33 is later curved to the reverse direction by the second movable roller 32*b* as the small-diameter roller Rs, the separation can be prevented from occurring.

That is to say, in the printer 1 of the embodiment, two transport rollers R are provided sequentially in a transport path to transport the medium S and respectively make contact with different surfaces of the medium S, in which the outer diameter of one of the transport rollers R differs from the outer diameter of the other of the transport rollers R. Note that the two transport rollers R sequentially provided in the transport path are transport rollers upon which a certain portion of the medium S is sequentially wound.

To be more specific, with regard to the first movable roller 32*a* and the fixed roller 33 sequentially provided in the transport path, the outer diameter of the fixed roller 33 is made larger than that of the first movable roller 32*a*. Further, with regard to the fixed roller 33 and the second movable roller 32*b* sequentially provided in the transport path, the outer diameter of the second movable roller 32*b* is made smaller than that of the fixed roller 33.

In other words, one of the two transport rollers R that are sequentially provided in the transport path and respectively make contact with different surfaces of the medium S is made to be the large-diameter roller Rl. In addition, the outer diameter of the large-diameter roller Rl is made large enough so that, even if the medium S is left unprocessed for a long time while being wound upon the large-diameter roller Rl in the main body 1' of the printer 1 at high temperature, the medium S will not have a tendency to have a curved shape to the degree which can cause a separation to occur. Further, the outer diameter of the large-diameter roller Rl is made large enough so that the separation will not occur even if the medium S having a tendency to have a curved shape is curved to the reverse direction by the large-diameter roller Rl.

With the configuration described above, a separation between the recording sheet and the separator (occurrence of separation) can be prevented. As a result, generation of defective products can be avoided.

In particular, as for the transport rollers R positioned further upstream of the transport path with respect to the print region, it is advisable that the outer diameters of two transport rollers R that are sequentially provided in the transport path and respectively make contact with different surfaces of the medium S are made different in size from each other.

With the above configuration, it is possible to prevent a separation from occurring in the medium S on which printing has yet to be carried out. As a result, it is possible to prevent the medium S from making contact with the head 42, thereby preventing the medium S from being got dirty, a failure of the head 42 from happening and so on. In addition, the skew of a dot forming position can be prevented from happening.

In the embodiment (FIG. 7), since the two movable rollers 32*a* and 32*b* out of the three transport rollers R are made to be the small-diameter rollers Rs, costs are more reduced than in the case of the comparison example where all of the transport rollers R are made to be the large-diameter rollers Rl as shown in FIG. 6B. In addition, a transport force to transport the medium S can be saved by using the small-diameter rollers Rs. Consequently, the output of a motor that rotationally drives the transport rollers R can be lowered so as to reduce costs and power consumption.

Further, in the embodiment (FIG. 7), the distance in the lateral direction between the transport rollers (32*a*, 33, 32*b*) sequentially provided is not extended, nor is lessened the distance in the up-down direction therebetween in order to make the winding angles θ smaller as in the case of the comparison example as shown in FIG. 6C. Accordingly, the apparatus is prevented from being larger in size, and the medium S can be held in a slack state as sufficiently as to cope with a case when feeding-out of the medium S from the feeding unit 20 is delayed.

In the printer 1 according to the embodiment, there are sequentially provided three transport rollers R in a transport path, in which a surface of a medium with which the first and third transport rollers from the upstream side of the transport path make contact differs from a surface of the medium with which the second roller makes contact. Further, the outer diameter of the second transport roller is made larger than the outer diameters of the first and third transport rollers. More specifically, the outer diameter of the fixed roller 33, which is the second transport roller from the upstream side of the transport path, is made larger than the outer diameters of the first movable roller 32*a* and the second movable roller 32*b*, which are respectively the first transport roller and the third transport roller from the upstream side.

With the above configuration, costs can be reduced because only the fixed roller 33 out of the three transport rollers (32*a*, 33, 32*b*), which are sequentially provided in the transport path and alternately make contact with the different surfaces of the medium, is needed to be the large-diameter roller Rl. In addition, a transport force to transport the medium S can be lessened.

Although the two movable rollers 32*a*, 32*b* and the fixed roller 33 are mainly focused on, rollers to be mentioned are not limited thereto. With regard to all the transport rollers disposed in the main body 1' of the printer 1 at high temperature, it is advisable that the outer diameters of two transport rollers that are sequentially arranged in a transport path and respectively make contact with different surfaces of a medium are different from each other.

For example, as shown in FIG. 2, a surface of the medium S with which the first movable roller 32*a* makes contact is different from a surface of the medium S with which the relay roller 31*a* positioned just in front of the first movable roller 32*a* (upstream side) makes contact. Therefore, if the first movable roller 32*a* is the small-diameter roller Rs, it is advisable that the relay roller 31*a* is made to be the large-diameter roller Rl.

Note that the second movable roller 32*b* and the relay roller 31*b* positioned right behind the second movable roller 32*b* (downstream side) make contact with the same surface of the medium S. In such case, it is not necessary to consider the relationship between the outer diameters of the two transport rollers 32*b* and 31*b* because a risk of occurrence of the separation is not present.

Transport Path of Variation

Figure 8:
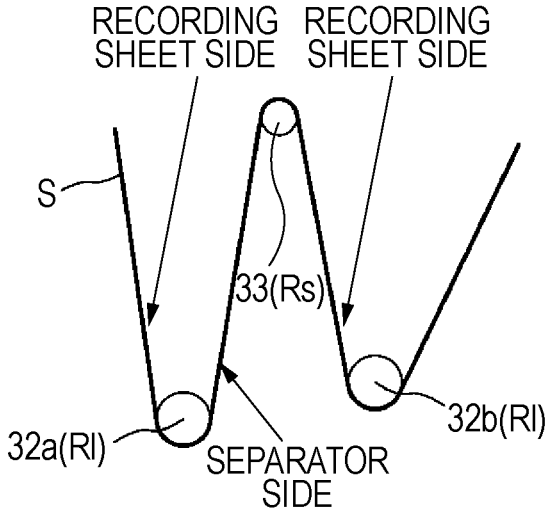
FIG. 8 is a descriptive view illustrating a transport path of a variation.

FIG. 8 is a view illustrating a transport path of a variation configured by the movable rollers 32*a*, 32*b* and the fixed roller 33. In the variation, the first movable roller 32*a* is the large-diameter roller Rl, the fixed roller 33 is the small-diameter roller Rs, and the second movable roller 32*b* is also the large-diameter roller Rl.

That is, in the variation in which there are sequentially provided three transport rollers in the transport path, if a surface of a medium (recording sheet) with which the first movable roller 32*a* first-positioned from the upstream side of the transport path and the second movable roller 32*b* third-positioned from the upstream side make contact, differs from a surface of the medium (separator) with which the fixed roller 33 second-positioned from the upstream side makes contact, the outer diameter of the first movable roller 32*a* first-positioned from the upstream side and the diameter of the second movable roller 32*b* third-positioned are made larger than the outer diameter of the fixed roller 33 second-positioned. Occurrence of the separation can be also prevented with such transport path.

To be more specific, a portion of the medium S that has been left unprocessed for a long time while being wound upon the first movable roller 32*a* as the large-diameter roller Rl is unlikely to have a tendency to have a curved shape because the degree to which the medium S is curved by the first movable roller 32*a* is small. Accordingly, even if the portion of the medium S that has been wound upon the first movable roller 32*a* for a long time is later wound upon the fixed roller 33 as the small-diameter roller Rs and curved to the reverse direction, occurrence of the separation can be prevented.

On the other hand, a portion of the medium S that has been left unprocessed for a long time while being wound upon the fixed roller 33 as the small-diameter roller Rs is likely to have a tendency to have a curved shape with the separator being inside the curve, and an adhesive strength of the adhesive layer thereof is lowered. However, the portion of the medium S that has been wound upon the fixed roller 33 for a long time is later wound upon the second movable roller 32*b* as the large-diameter roller Rl. Therefore, even if the portion of the medium S mentioned above is curved to the reverse direction, occurrence of the separation can be prevented because the degree to which the medium S is curved is small.

It is to be noted that the aforementioned transport path (FIG. 7) according to the embodiment can lessen the number of the large-diameter rollers Rl in comparison with the transport path of the variation (FIG. 8), thereby making it possible to reduce the costs and power consumption.

Other Embodiments

Although the image recording apparatus is mainly described in the above embodiment, the disclosure of the method for recording an image and the like is also included in the invention. In addition, it is to be noted that each of the embodiments is intended to facilitate understanding of the invention and does not impose any limit to interpretation of the invention. The invention can be varied or improved without departing from the spirit and scope of the invention, and it is needless to say that products equivalent to those in the invention are included in the invention. In particular, the following embodiments are also included in the invention.

Other Types of Printers

Although, in the aforementioned embodiment, the printer 1 that prints an image by moving the head 42 in the X and Y directions with respect to the roll paper placed in the print region is cited as an example, the printer is not limited thereto. For example, a printer that prints an image when the roll paper passes under a fixed head can be cited. In addition, the medium for recording an image is not limited to roll paper, and may be single sheets of paper. Further, an image recording apparatus that prints an image by discharging liquid other than ink through nozzles can be cited.

The image recording apparatus is not limited to a printer. The same techniques as those described in the aforementioned embodiments may be applied to various apparatuses, to which the ink jet technique is applied, such as a color filter manufacturing apparatus, a printing apparatus, a microfabrication apparatus, a semiconductor manufacturing apparatus, a surface processing apparatus, a three-dimensional modeling apparatus, a gas vaporizer, an organic EL manufacturing apparatus (macromolecular EL manufacturing apparatus, in particular), a display manufacturing apparatus, a thin film deposition apparatus, a DNA chip manufacturing apparatus, and so on. It should be noted that the technical methods, manufacturing methods and the like thereof are also included in the range of application of the invention.

What is claimed is:

1. An image recording apparatus comprising:

a transport unit that transports a medium, which includes a recording material one side of which is a recording layer for an image and the other side of which is an adhesive layer and also includes a separating material covering the adhesive layer, along a transport path using a plurality of transport rollers;

a recording unit that records an image on the medium; and a heating unit that fixes the image recorded on the medium, wherein two units of the transport rollers are provided sequentially in the transport path, with the two units of transport rollers including paired transport rollers having a driving roller and a driven roller and a plurality of single relay transport rollers each being configured to contact a surface of the medium alone at a point of contact of the single relay transport roller with the medium, wherein two sequentially positioned single relay transport rollers respectively make contact with different surfaces of the medium, and an outer diameter of one of the transport rollers is different in size from an outer diameter of the other of the transport rollers.

2. The image recording apparatus according to claim 1, wherein there are sequentially provided three units of the transport rollers in the transport path, and a surface of the medium with which a first transport roller and a third transport roller of the three transport rollers from an upstream side of the transport path make contact is different from a surface of the medium with which a second transport roller of the three transport rollers makes contact, and wherein an outer diameter of the second transport roller is larger than an outer diameter of the first transport roller and an outer diameter of the third transport roller.

3. The image recording apparatus according to claim 1, wherein there are sequentially provided three units of the transport rollers in the transport path, and the surface of the medium with which a first transport roller and a third transport roller of the three transport rollers from the upstream side of the transport path make contact is different from the surface of the medium with which a second transport roller of the three transport rollers makes contact, and wherein the outer diameter of the first transport roller and the outer diameter of the third transport roller are larger than the outer diameter of the second transport roller.

4. The image recording apparatus according to claim 1, wherein the two transport rollers that have different outer diameters from each other are positioned further upstream of the transport path with respect to a region where the recording unit records an image on the medium.

5. The image recording apparatus according to claim 1, wherein the medium winds around each of the two units of the transport rollers with a winding angle greater than 0 degrees.

6. The image recording method of claim 1, wherein the medium winds around each of the two units of the transport rollers with a winding angle greater than 0 degrees.

7. An image recording method comprising:

recording an image on a medium using an image recording apparatus, the image recoding apparatus including:

a transport unit that transports the medium, which includes a recording material one side of which is a recording layer for an image and the other side of which is an adhesive layer and also includes a separating material covering the adhesive layer, along a transport path using a plurality of transport rollers;

a recording unit that records the image on the medium; and a heating unit that fixes the image recorded on the medium, wherein two units of the transport rollers are provided sequentially in the transport path, with the two units of transport rollers including paired transport rollers having a driving roller and a driven roller and a plurality of single relay transport rollers each being configured to contact a surface of the medium alone at a point of contact of the single relay transport roller with the medium, wherein two sequentially positioned single relay transport rollers respectively make contact with different surfaces of the medium, and an outer diameter of one of the transport rollers is different in size from an outer diameter of the other of the transport rollers.

* * * * *